US005308189A

United States Patent [19]

Claing

[11] Patent Number: 5,308,189

[45] Date of Patent: May 3, 1994

[54] GRIPPING DEVICE FOR RETAINING A RING MEMBER SUPPORTING A MANHOLE COVER

[76] Inventor: Jean-Louis Claing, 337, rue Principale, St-Bernard de Michaudville, Quebec, Canada, J0H 1C0

[21] Appl. No.: 897,947

[22] Filed: Jun. 15, 1992

[51] Int. Cl.[5] ..... E02D 29/14

[52] U.S. Cl. ..... 404/26; 404/25

[58] Field of Search ..... 404/25, 26

[56] References Cited

U.S. PATENT DOCUMENTS

| | | | |
|---|---|---|---|
| 3,773,428 | 11/1973 | Bowman | 404/26 |
| 3,920,347 | 11/1975 | Sauriol et al. | 404/25 |
| 4,305,679 | 12/1981 | Modi | 404/25 |
| 4,466,219 | 8/1984 | Campolito | 404/25 X |
| 4,690,584 | 9/1987 | LeBaron | 404/26 |
| 4,867,600 | 9/1989 | Bowman | 404/26 |
| 5,039,248 | 8/1991 | Bowman | 404/26 |

*Primary Examiner*—Mark Rosenbaum
*Assistant Examiner*—Frances Chin

[57] ABSTRACT

The present invention is directed to a gripping system for holding a supporting ring member adapted to support a manhole cover in a tubular member having a peripheral horizontal shoulder. The gripping system has a plurality of rigid elbow-shaped members internally secured inside the ring member. The elbow-shaped members have a horizontal arm radially extending inside the ring member and a substantially vertical pending arm extending below the ring member and adapted to internally face the tubular member. A screw member is threadedly mounted through the vertical arm in the direction of the tubular member. The screw member is provided with a friction plate fixed at one end between the vertical arm and the tubular member for tightening the friction plate on the tubular member and for frictionally retaining the ring member to the tubular member. The friction force is adapted to vertically fix the ring member relative to the tubular member.

7 Claims, 2 Drawing Sheets

GRIPPING DEVICE FOR RETAINING A RING MEMBER SUPPORTING A MANHOLE COVER

BACKGROUND OF THE INVENTION

1. Field of the Invention

The present invention relates to a gripping device for preventing a ring member supporting a manhole cover from being lifted unintentionally. It is particularly directed to a plurality of friction plates secured to the ring member and adapted to be tightened to the cylindrical housing of the manhole. The novel gripping device does not hinder a worker from going down the tubular member in the manhole.

2. Prior Art

U.S. Pat. No. 5,078,539 issued to the present applicant describes a raising structure for manhole cover. Such a structure may be lifted unintentionally by vehicles traveling over a manhole cover and more specifically by a grader or a snow plow scraping the ground around the manhole.

In U.S. Pat. No. 3,926,533 describes the structure of a manhole in which the support for the cover is held by a plurality of staples. U.S. Pat. No. 4,475,845 describes an external manhole chimney seal which may be considered as a means for holding the casting supporting the manhole cover. Such a holding means grips the external surface of the casting and a spinning adjusting ring and is mainly concerned with a sealing function.

H. Bowman in U.S. Pat. Nos. 4,963,053 and 4,872,780 describes a ring member for supporting a manhole cover. The ring member includes a turnbuckle arrangement to tighten the ring member in its housing.

The annular support for manhole cover described by A. Prescott in U.S. Pat. No. 4,995,757 makes use of bolt members radially engaged through the ring support to project the tip of the bolts against a surrounding collar. Considering that the collars are always made of molded cast iron or concrete, they are slightly tapered outwardly to satisfy the molding procedure. Whenever there is a slight movement of the cover and the supporting ring, the tip of the bolts loosen up and the conicity of the collars unlock the supporting ring.

SUMMARY OF THE INVENTION

The present invention is directed to a gripping system for holding a supporting ring member adapted to support a manhole cover in a tubular member having a peripheral horizontal shoulder. The gripping system has a plurality of rigid elbow-shaped members internally secured inside the ring member. The elbow-shaped members have a horizontal arm radially extending inside the ring member and a substantially vertical pending arm extending below the ring member and adapted to internally face the tubular member. A screw member is threadedly mounted through the vertical arm in the direction of the tubular member. The screw member is provided with a friction plate fixed at one end between the vertical arm and the tubular member for tightening the friction plate on the tubular member and for frictionally retaining the ring member to the tubular member. The friction force is adapted to vertically fix the ring member relative to the tubular member.

The friction plate is preferably made of a metal backing and a resilient plastic material wherein the screw member freely rotates in the metal backing and threadedly engages the vertical pending arm.

DETAILED DESCRIPTION OF THE INVENTION

Figure 1:
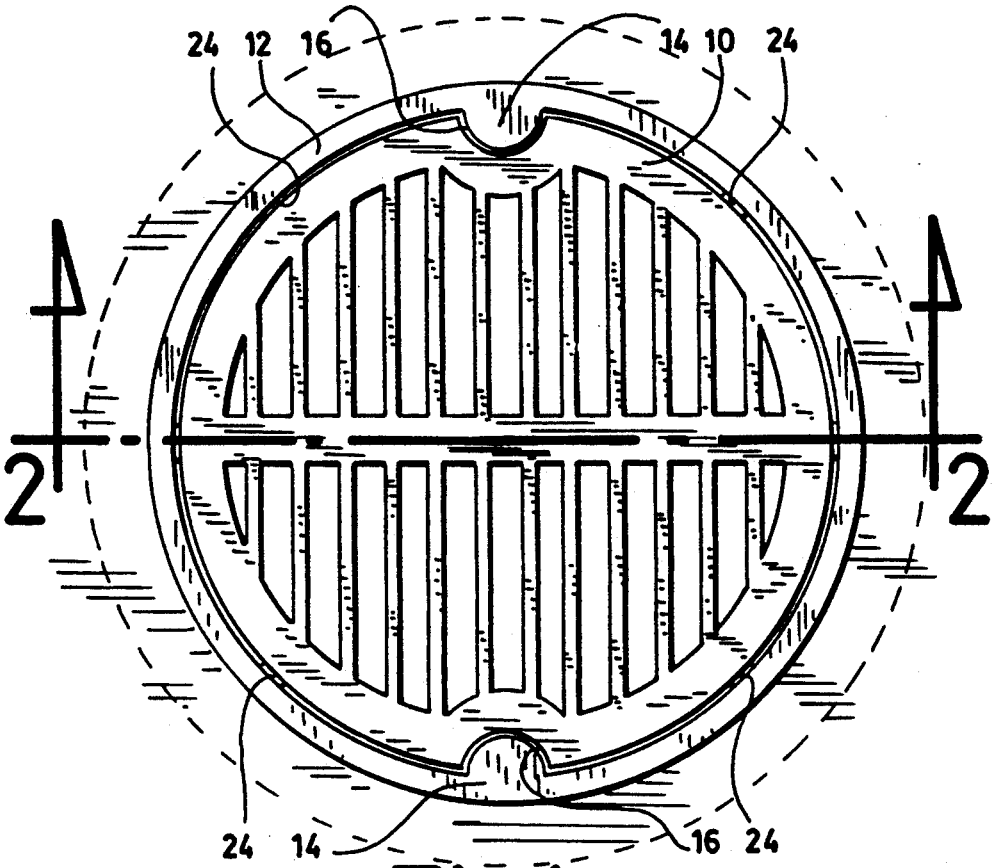
FIG. 1 is a top view of a manhole cover adapted to be supported according to the invention.

FIG. 1 illustrates a manhole cover 10 mounted in a peripheral frame 12 adapted to be locked in rotation by a pair of prongs 14 projecting inside a pair of indentations 16 provided in the periphery of the cover 10. Although the cover 10 is prevented from rotating on a horizontal plane by the prongs 14, a ring member including rings 20 and 22 can be maliciously removed or unintentionally raised particularly by graders or plows. To overcome such undesirable action, it has been contemplated previously to use threaded rods to extend through the supporting ring members such as described in U.S. Pat. No. 4,995,757. Such a procedure has been found unsatisfactory considering that the tubular members surrounding the supporting ring members of the cover are generally made of cast iron or concrete. It has been found that, although the threaded rods were sharpened at their end contacting their tubular member, it could not be considered as sufficiently well retained inside the tubular member. Such unreliable gripping arrangement was due to the fact that the vibration of the cover, whenever vehicles were travelling over, would cause the cast iron or the concrete to crumble. Furthermore, considering that the tubular member, due to the molding procedure, are slightly tapered upwardly, the tightening screws quickly loosen up to free the ring members inside the tubular member.

Figure 2:
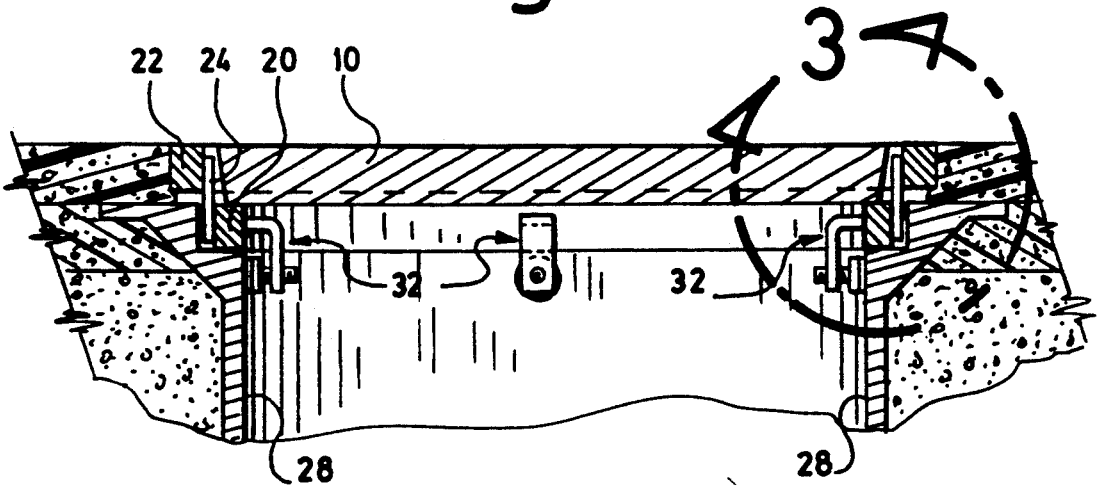
FIG. 2 is a cross-sectional view along line 2—2 of FIG. 1 illustrating the gripping devices according to the invention.

The ring gripping arrangement illustrated in FIG. 2 is particularly described for a raising structure for manhole cover as described in the applicant's U.S. Pat. No. 5,078,539 issued on Jan. 7, 1992. It is directed to a raising structure and particularly to a ring member comprising a base ring 20 and a top ring 22 concentrically mounted and vertically spaced by a plurality of spacing legs 24. The base ring 20 rests on a peripheral horizontal shoulder 26 of a tubular member 28 extending down the manhole. The base ring 20 is adapted to sit firmly on the shoulder 26 and to support the cover 10 while the top ring 22 is adapted to be level with the surrounding asphalt pavement 30 and cover 10.

The purport of the present invention is to provide a device for retaining the ring members comprising the combination of the rings 20 and 22 onto the shoulder 26. The gripping device comprises a plurality of elbow-shaped members 32 having a horizontal arm 34 radially secured inside the base ring 20 and more specifically welded to the inner surface of the ring 20. The elbow-shape member 32 also includes a vertical pending arm 36 extending below the base ring 20 and adapted to face a portion of the inner surface of the tubular member 28. A screw member comprising a threaded rod 40 is threadedly mounted through the vertical arm 36. A backing plate 42 is mounted at one end of the rod 40 and is adapted to be freely rotatable on the rod 40 so that when the rod 40 is twisted, the backing plate does not have to rotate with the rod. A resilient plastic material 44 such as polyurethane of high density is glued on the outer surface of the backing plate 42 on the side facing the tubular member 28.

The end of the threaded rod 40 extending towards the center of the tubular member 28 is provided with a hole 46 corresponding to the configuration of an Allen key for tightening the screw 40 in the direction of the tubular member 28 for frictionally engaging the plastic material 44 against the inner surface of the tubular member 28.

The size of the components in the gripping arrangement determines the degrees of friction required for maintaining the base ring 20 against the tubular member 28.

The elbow-shaped member 32 is generally made mild steel having a thickness of about ⅜ inches and a width of 1 inch. The horizontal arm 34 extends inwardly by about one inch and the vertical arm 36 extends downwardly by about 1.5 inches. The metal backing 42 and the plastic material 44 are preferably circular and have a diameter of about 1.5 inches. The plastic material 44 has a thickness of about ¼ inch for allowing compression thereof when a torque of about 100 to 150 inch pounds is applied to the screw 40. The area of the plastic material 44 is of about 1.5 to 2 square inches so that a pulling force of about 1500 to 2500 pounds will be required for pulling the base ring 20 upwardly from the tubular member 28. This pulling force can be obtained when three but preferably four elbow-shaped members 32 are secured to the ring 20, equidistantly positioned and equally tightened on its inner surface. A greater number of elbow-shaped members such as 32 may be used if a greater pulling force is needed.

One simple method of mounting the backing plate 42 and the plastic material 44 can be performed as follows. The threaded rod 40 is provided at one end with a smaller cylindrical shaft 48 which provides a shoulder 50 which abuts against the backing plate 42 and provides a pressure surface over the backing plate 42. The free end of the shaft 48 is preferably made of a uniform diameter to be inserted into the backing plate 42 but is subsequently countersink to spread out the end of the shaft 48 into a V-shaped configuration 49 for retaining the latter to the backing plate 42. After this operation has been completed, the plastic material 44 is glued on the surface of the backing plate 42.

Such operation can be simply produced by punching the end of the shaft 48 causing its spreading out as well as the spreading out of the plate 42.

Figure 4:
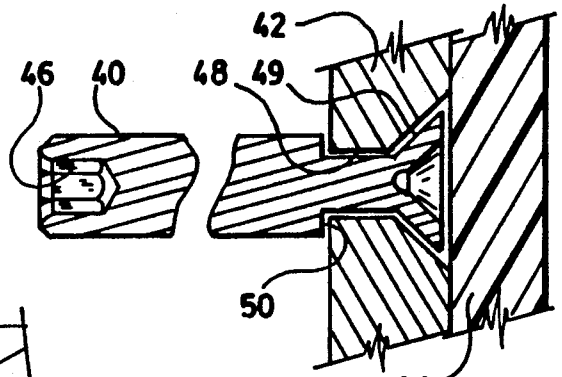
FIG. 4 is a vertical cross-sectional view through the threaded member shown in FIG. 3.
Figure 4A:
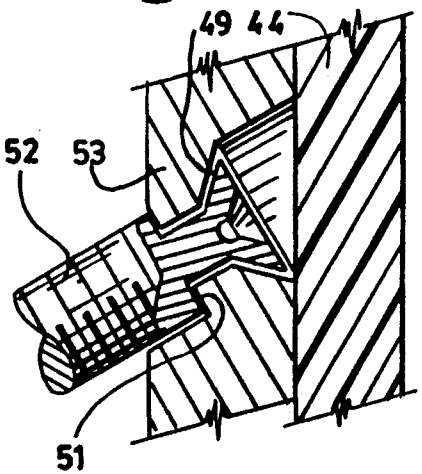
FIG. 4*a* is a vertical cross-sectional view taken through the screw member shown in FIG. 3*a*.
Figure 3A:
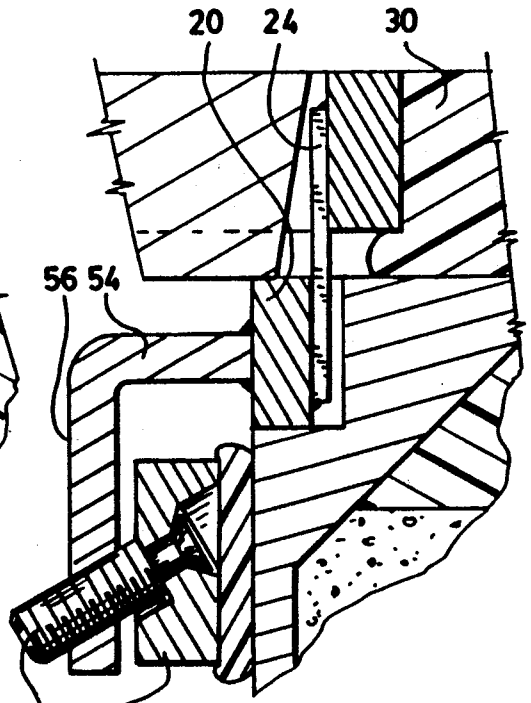
FIG. 3*a* is an alternative embodiment of FIG. 3.
Figure 3:
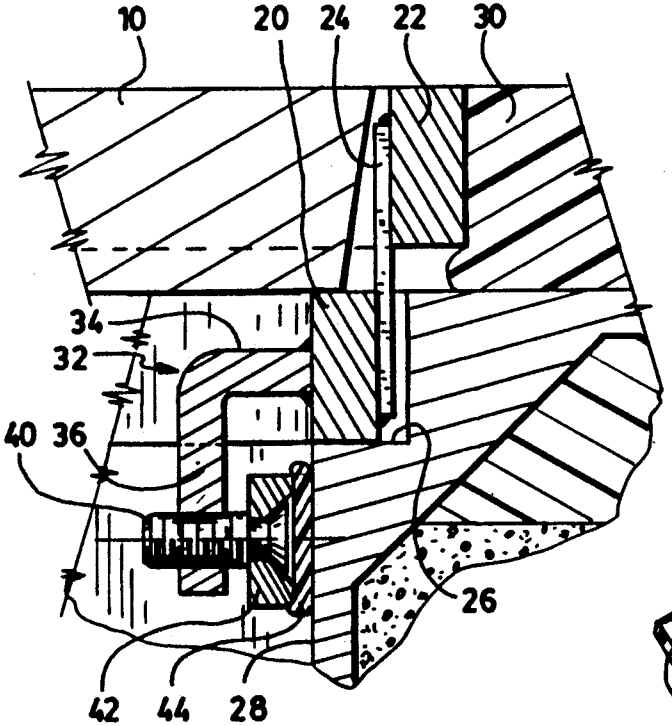
FIG. 3 is an enlarged view of the encircled portion 3 shown in FIG. 2.

In order to provide a more positive pressure on the backing plate 53 as shown in FIGS. 3*a* and 4*a*, the threaded rod 52 is angularly positioned relative to the surface of the backing plate 53 in an upward direction. Such angularity of the threaded rod 52 also take into consideration the possibility of any increase in the angle between the horizontal arm 54 and the vertical arm 56 whenever the torque applied produces a slight spreading out of the right angle between the two arms 54 and 56. The twisting of the rod 52 produces an abutting force of the shoulder 51 on the backing plate 53 which tightens the plastic material 44.

I claim:

1. In a manhole cover, a gripping device for retaining a ring member supporting the manhole cover, said supporting ring member comprising means for sitting on a peripheral horizontal shoulder of an upstanding tubular member mounted in a manhole, said gripping device comprising a plurality of rigid elbow-shaped members having a substantially horizontal arm radially secured inside said ring member and a substantially vertical pending arm extending below said ring member to internally face said tubular member, a screw member threadedly mounted through said vertical arm in the direction of said tubular member, a friction plate fixed to said screw member at one end thereof between said vertical arm and said tubular member, said screw member being rotatable in said vertical arm for tightening said friction plate on said tubular member to thereby frictionally retain said ring member to said tubular member and vertically fix said ring member on said shoulder relative to said tubular member, wherein said ring member and each elbow-shaped member are made of steel and welded together at one end of said horizontal arm, and wherein said friction plate is made of resilient plastic material for preventing said plate from upwardly sliding on said tubular member and from being unintentionally lifted from said shoulder.

2. A gripping device as recited in claim 1, wherein said plastic material has rigid metal backing for maintaining said friction plate parallel to said tubular member, said metal backing having a central aperture, and said screw member having a projection at one end mounted through said aperture and freely rotatable thereinto so that rotation of said screw member laterally translate said friction plate in the direction of said tubular member.

3. A gripping device as recited in claim 2, wherein said resilient plastic material is a rigid polyurethane.

4. A gripping device as recited in claim 3, wherein said ring member comprises upper and lower connectedly superposed concentric rings vertically spaced from the another, the lower ring having a smaller diameter than the upper ring, said lower ring being secured to said horizontal arm for sitting on said shoulder.

5. A gripping device as recited in claim 4, wherein said plastic material is about ¼ inch thick for allowing compression of said material upon tightening of said screw member with a torque of about 100 to 150 inch pounds.

6. A gripping device as recited in claim 5, wherein said plastic material has an area of about 1.5 to 2 square inches for resisting, when at least three rigid elbow-shaped members are provided, an upward pull of about 1500 to 2500 lbs of said ring member.

7. A gripping device as recited in claim 3, wherein said screw member is angularly positioned through said metal backing in an upward direction, for increasingly resisting upward movement of said ring member.

* * * * *